US005137273A

United States Patent [19]

Jseng

[11] Patent Number: 5,137,273

[45] Date of Patent: Aug. 11, 1992

[54] RACKET

[75] Inventor: Kuni Jseng, 6F-1, No. 342, Keelung Rd., Sec. 1, Taipei, Taiwan

[73] Assignee: Kuni Jseng, Taipei, Taiwan

[21] Appl. No.: 675,911

[22] PCT Filed: Feb. 5, 1990

[86] PCT No.: PCT/US90/00666

§ 371 Date: Apr. 26, 1991

§ 102(e) Date: Apr. 26, 1991

[51] Int. Cl.[5] ..... A63B 51/10

[52] U.S. Cl. ..... 273/73 D; 273/73 R

[58] Field of Search ..... 273/73 R, 73 C, 73 D, 273/73 E, 73 G

[56] References Cited

U.S. PATENT DOCUMENTS 1,663,039 3/1928 Craven ..... 273/73 E
2,165,701 7/1939 Goerke .
4,322,076 3/1982 Bertram et al. .
4,333,650 6/1982 Soong ..... 273/73 D
4,437,662 3/1984 Soong .
4,488,722 12/1984 Harz .
4,589,662 5/1986 Robaldo .
4,690,405 9/1987 Frolow .

FOREIGN PATENT DOCUMENTS 2586936 3/1987 France .
2191409 12/1987 United Kingdom .

*Primary Examiner*—Theatrice Brown
*Assistant Examiner*—William E. Stoll

[57] ABSTRACT

A racket comprises a frame, a throat and a handle, within the frame a plurality of longitudinal and transverse strings form the strike surface, characterized in that at the position inside the frame near to the throat is provided with an elastic band extending transversely over the width of the strike surface, preferably intermitted at the center, which is preformed with a plurality of apertures in a number and at interval corresponding to the longitudinal strings, so that the longitudinal strings extend in parallel to each other from top of the frame until passing through apertures in the band, then extend convergently to the throat.

4 Claims, 1 Drawing Sheet

RACKET

BACKGROUND OF THE INVENTION

This invention relates to a novel racket, particularly to a racket provided with a shock absorbent and equalizing elastic band.

Conventionally, the racket mainly comprises a frame, a throat and a handle. Within said frame the longitudinal and transverse interweaving strings form the strike surface.

The present invention provides an improved racket with respect to the kind mentioned above, in which at the position inside the frame near to the throat is provided with an elastic band extending transversely over the width of the strike surface, preferably intermitted at the center, which is preformed with a plurality of apertures in a number and at intervals corresponding to the longitudinal strings, so that said longitudinal strings are extended in parallel to each other from top of the frame until passing through said apertures in said band, then extended convergently, to the throat.

BRIEF DESCRIPTION OF THE DRAWINGS

The aforementioned and other objects, features and advantages will be better understood from the following description in detail, with reference to the embodiment illustrated in the accompanying drawings, in which.

DETAILED DESCRIPTION OF THE DRAWINGS

Figure 1:
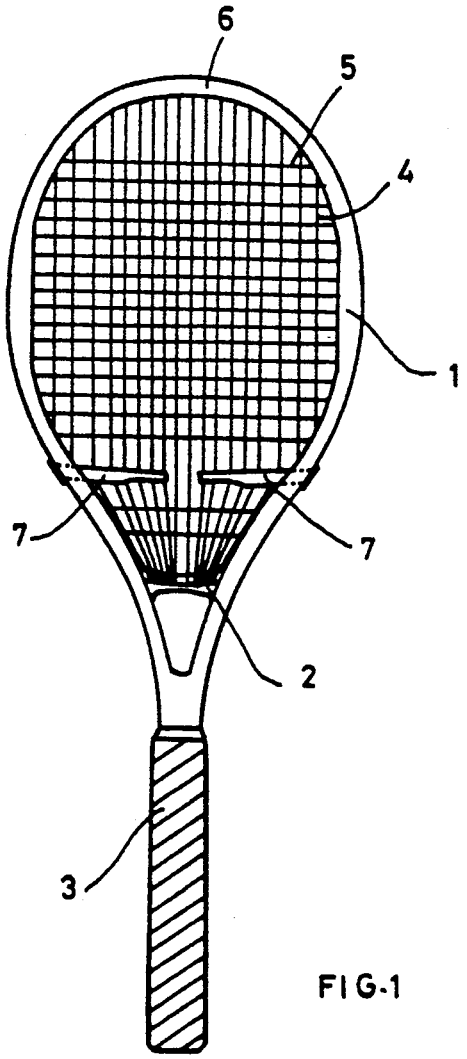
FIG. 1 is plane view of one embodiment in tennis racket type of novel racket according to the present invention.

Now, referring to FIG. 1, the present novel racket, as usual racket, mainly comprises a frame 1, a throat 2 and a handle 3. Within the area bound by the frame 1, a plurality of longitudinal strings 4 and a plurality of transverse strings 5 are interwoven to form the strike surface. In a kind of conventional racket, the longitudinal strings 4 are extended from top 6 of the frame 1 until the throat 2. Since the width of the frame 1 is far greater than the width of the throat 2, in the conventional racket either the longitudinal strings 4 have no identical length, or the longitudinal strings 4 at both sides are convergently extended to the throat 2 and those closer to the frame sides have greater inclination, except that only two central longitudinal strings 4 are extend substantial parallel to each other until said throat 2.

Figure 2:
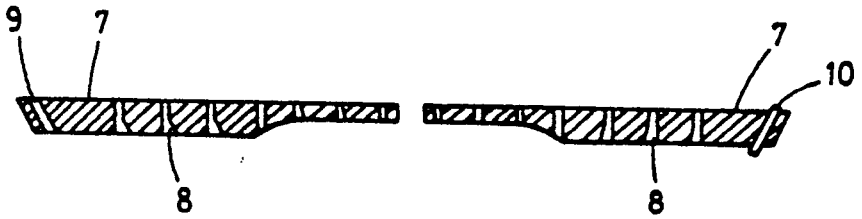
FIG. 2 is an enlarged transverse cross section of the elastic band according to the present invention.

The present invention is characterized that within the strike surface near to the throat 2 out of the sweet spot is provided with an elastic band 7 extending transversely over the width of the frame 1, namely, from one side to another side of the frame, and preferably intermitted at the center as shown, so that a pair of band sections are substantially presented. The band 7 is made of elastic material, preferably elastomeric resin, in particular polyamides. Meanwhile, as referred to FIG. 2, the band 7 is preformed with a plurality of longitudinal apertures 8 in a number equal to the longitudinal strings 4 which will be passed through. The interval between adjacent apertures 8 corresponds to that between adjacent strings 4. Thereby, all of longitudinal strings 4 are extended in parallel to each other within entire sweet spot of the strike surface until passing through respective apertures 8 of the band 7, then extended convergently from the band 7 to the throat 2 as illustrated.

In cooperation with the inclination when the strings 4 extend from said band 7 to throat 2 convergently, the apertures 8 in the band 7, except those two at center, are formed inclindly towards the center, with inclination incrementally increased towards both sides. The obligue openings 9 at both margin edges are inclined at an angle corresponding to the configuration of the frame 1 at which location the band 7 is mounted, and extend out of the frame 1 to be secured by inserting respective pins 10. The fastening strength of said band 7 will be enhanced by the stress exerted by the longitudinal strings 4 when convergently passing through said band 7. The band 7 is preferably widened at both outer sides since the stress at said outer sides is greater than at inner sides which are thinner.

Two outmost longitudinal strings 4 at each side are fastened through the frame 1 as shown rather than extended passing through the band 7, but additional secondary shorter elastic bands (not shown) may be optionally provided therefor.

The present invention providing the elastic band 7 in the racket performs not only to keep all of the longitudinal strings 4 extended within the sweet spot in parallel to each other to obtain stable strike and control of the balls, but also to increase the rebound effect and to reduce the vibration. Moreover, the band 7 is located out of the sweet spot without impairing any strike performances.

The present invention may be formed in tennis racket as shown in FIG. 1 or other racket, such as squash racket and the like, not shown.

While there have been shown and described what are at present considered the preferred embodiments of the present invention, it will be obvious to those skilled in the art that various changes and modifications may be made therein without departing form the scope of the invention as defined by the appended claims. For example, the band 7 may be enlarged at margin edges for stopping at outside of the frame 1, when said band 7 is inserted therefrom, to be secured thereon, then said oblique openings 9 and the pins 10 can be neglected.

I claim:

1. A racket comprising a frame, a throat and a handle, within said frame a plurality of longitudinal and transverse strings interweaving to form a strike surface, said longitudinal strings extending from a top of said frame to said throat, comprising a position inside said frame near the throat out of a sweet spot which is provided with an elastic band extending transversely over the width of said strike surface, said band being intermitted at its center so that a pair of band sections are presented, said band being preformed with a plurality of apertures in a number and at intervals corresponding to that of said longitudinal strings, so that said longitudinal strings extend in parallel to each other from the top of said frame until passing through said apertures in said band, then extend convergently to said throat.

2. The racket as set forth in claim 1, wherein said apertures in said band except those two at center are formed inclindly towards the center, with inclination incrementally increased towards both sides.

3. The racket as set forth in claim 1, wherein said elastic band at both margin edges is extended outside of said frame and secured thereon.

4. The racket as set forth in claim 1, wherein the outmost longitudinal strings that do not extend passing through said band are fastened through said frame.

* * * * *